US006237497B1

(12) United States Patent
Altenau et al.

(10) Patent No.: US 6,237,497 B1
(45) Date of Patent: May 29, 2001

(54) SPIN-STABILIZED ARTILLERY PROJECTILE HAVING GAS PRESSURE EQUALIZING MEANS

(75) Inventors: Ernst-Wilhelm Altenau, Duisburg; Siegmar Fischer, Celle; Günter Sikorski, Düsseldorf; Ralf Aumund-Kopp, Lüneburg; Margret Klütsch, Frechen, all of (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/286,838

(22) Filed: Apr. 6, 1999

(30) Foreign Application Priority Data

Apr. 6, 1998 (DE) ..... 198 15 295

(51) Int. Cl.[7] ..... F42B 12/00; F42B 12/06

(52) U.S. Cl. ..... 102/524; 102/524; 102/517; 102/516; 102/514

(58) Field of Search ..... 102/524, 517, 102/516, 514

(56) References Cited

U.S. PATENT DOCUMENTS

| | | | | |
|---|---|---|---|---|
| 2,809,587 | | 10/1957 | Musser . | |
| 3,058,424 | | 10/1962 | Grandy . | |
| 3,769,912 | * | 11/1973 | Friend | 102/93 |
| 4,708,065 | | 11/1987 | Schilling et al. . | |
| 4,747,191 | * | 5/1988 | Montier et al. | 29/1.23 |
| 4,860,659 | | 8/1989 | Andreetta . | |
| 4,879,790 | * | 11/1989 | Garrett | 29/1.2 |
| 4,955,938 | * | 9/1990 | Romer et al. | 102/430 |
| 5,081,931 | * | 1/1992 | Frye et al. | 102/489 |
| 5,305,505 | * | 4/1994 | Ruhlman | 29/1.2 |
| 5,449,874 | * | 9/1995 | Altenau | 219/76.12 |
| 6,085,662 | * | 7/2000 | Nilsson | 102/526 |

FOREIGN PATENT DOCUMENTS

| | | |
|---|---|---|
| 1 912 751 | 10/1970 | (DE) . |
| 84 33 256 | 7/1988 | (DE) . |
| 41 37 417 | 6/1993 | (DE) . |
| 295 16889 U | 3/1996 | (DE) . |
| 0 246 205 | 11/1987 | (EP) . |
| 480605 | 2/1938 | (GB) . |
| 725821 | 3/1955 | (GB) . |
| 2 054 903 | 11/1980 | (GB) . |

* cited by examiner

*Primary Examiner*—Michael J. Carone
*Assistant Examiner*—Lulit Semunegus
(74) *Attorney, Agent, or Firm*—Venable; Gabor J. Kelemen

(57) ABSTRACT

A spin-stabilized projectile adapted to be fired from a weapon barrel, includes a projectile body having a length dimension, a rear length portion, an ogive-shaped front length portion and an intermediate length portion situated between the rear and front length portions; a metal guide band circumferentially mounted on the projectile body; and an undercut provided circumferentially in the intermediate length portion to define an annular chamber with an inner surface of the weapon barrel during travel of the projectile in the weapon barrel upon firing for effecting a pressure equalization of propellant gases flowing past the metal guide band to center the projectile within the weapon barrel.

4 Claims, 2 Drawing Sheets

SPIN-STABILIZED ARTILLERY PROJECTILE HAVING GAS PRESSURE EQUALIZING MEANS

CROSS REFERENCE TO RELATED APPLICATION

This application claims the priority of German Application No. 198 15 295.7 filed Apr. 6, 1998, which is incorporated herein by reference.

BACKGROUND OF THE INVENTION

This invention relates to a spin-stabilized artillery projectile of the type fired from a weapon barrel and having a projectile body which is ogive-shaped in its frontal region.

Projectiles of the above-outlined type are known, for example, from German Gebrauchsmuster (utility model) G 84 33 256.5. The projectile body of these types of artillery projectiles conventionally carries a circumferential guide band at a rearward part of the projectile body. The guide band is of metal, for example, soft iron or copper or may consist of a plastic material. The outer diameter of the guide band is greater than the caliber diameter of the barrel so that upon firing of the projectile, the guide band is pressed into the barrel rifling and prevents combustion gases from flowing past the projectile. As the projectile moves forward in the barrel, the rifling imparts a stabilizing rotation on the projectile via the guide band.

It is further known from the above-identified German utility model to provide an additional polymer obturator ring adjacent the guide band and facing the rear terminus of the projectile.

Guide bands of artillery projectiles which, for reaching a high muzzle velocity, are fired from long (for example, 52 caliber) barrels, are exposed to substantial wear. As a result, the spin transmission and sealing functions of the guide bands are frequently not performed reliably and, particularly in projectiles having a conventional obturator and a copper guide band, after firing, partially deep engravings on the projectile body may appear. Such a "body-engraving" leads to an increased wear of the weapon barrel and negatively affects the trajectory of the projectile. Also, risks are considerable that explosive projectile payload detonates prematurely within the weapon barrel.

SUMMARY OF THE INVENTION

It is an object of the invention to provide an improved spin-stabilized artillery projectile which, upon firing from the weapon barrel, has a reduced guide band wear as compared to known projectiles and in which, in particular, a body-engraving is significantly diminished. This object and others to become apparent as the specification progresses, are accomplished by the invention, according to which, briefly stated, the spin-stabilized projectile adapted to be fired from a weapon barrel includes a projectile body having a length dimension, a rear length portion, an ogive-shaped front length portion and an intermediate cylindrical length portion situated between the rear and front length portions; a metal guide band circumferentially mounted on the projectile body; and an undercut provided circumferentially in the intermediate length portion to define an annular chamber with an inner surface of the weapon barrel during travel of the projectile in the weapon barrel upon firing for effecting a pressure equalization of propellant gases flowing past the metal guide band to center the projectile within the weapon barrel.

The invention is based on the principle to provide, between the guide band and the ogive-shaped frontal region of the projectile body, at least in one partial zone thereof, an undercut which extends annularly about the projectile and which is so configured that in the annular chamber formed between the outer surface of the projectile body and the inner wall of the weapon barrel, a pressure equalization of the combustion gases flowing past the projectile is effected. In this manner, a centering of the projectile in the weapon barrel occurs, as a result of which the projectile, after leaving the weapon barrel, follows its predetermined flight path. Further, the unilateral stresses imparted to the weapon barrel by the conventional projectiles are significantly reduced. Tests have shown that for achieving a sufficient projectile stabilization, the length L1 of the undercut should be between 70% and 80%, preferably approximately 75%, of the total length L0 of the cylindrical projectile part which extends between the guide band and the ogive-shaped frontal region of the projectile. The depth of the undercut should be approximately between 0.3% and 0.6% of one half of the maximum projectile diameter.

It has been found to be advantageous to provide that the undercut does not adjoin immediately the guide band but is separated therefrom by approximately 30–35% of the remaining length $\delta L = L0 - L1$.

A further significant reduction of the guide band wear is obtained by providing that the guide band is of soft iron instead of copper and that the projectile, in addition to the guide band, has an obturator made of a heat-resistant elastomer. Particularly nylon has been found to be a satisfactory material for the obturator.

DESCRIPTION OF THE PREFERRED EMBODIMENT

Figure 1:
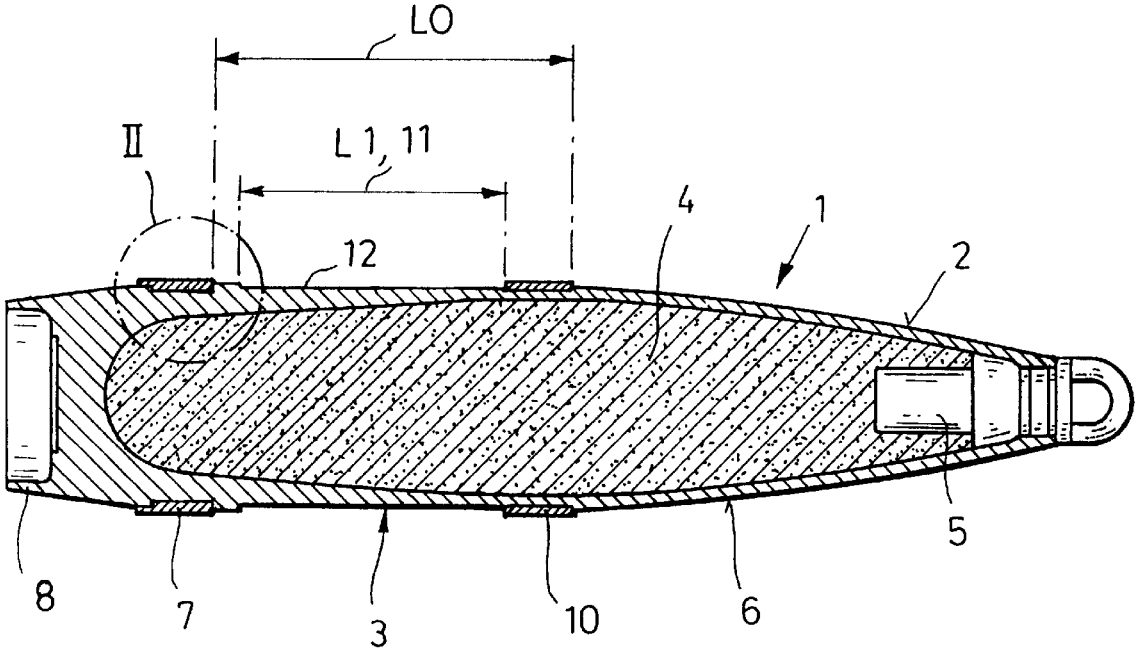
FIG. 1 is an axial sectional view of a projectile incorporating the invention.

FIG. 1 shows an artillery projectile 1 having an ogive-shaped frontal region 2. The projectile 1 is composed essentially of a projectile body 3 which accommodates an explosive payload 4 and an impact igniter 5 screwed into the front end of the projectile body.

Figure 2:
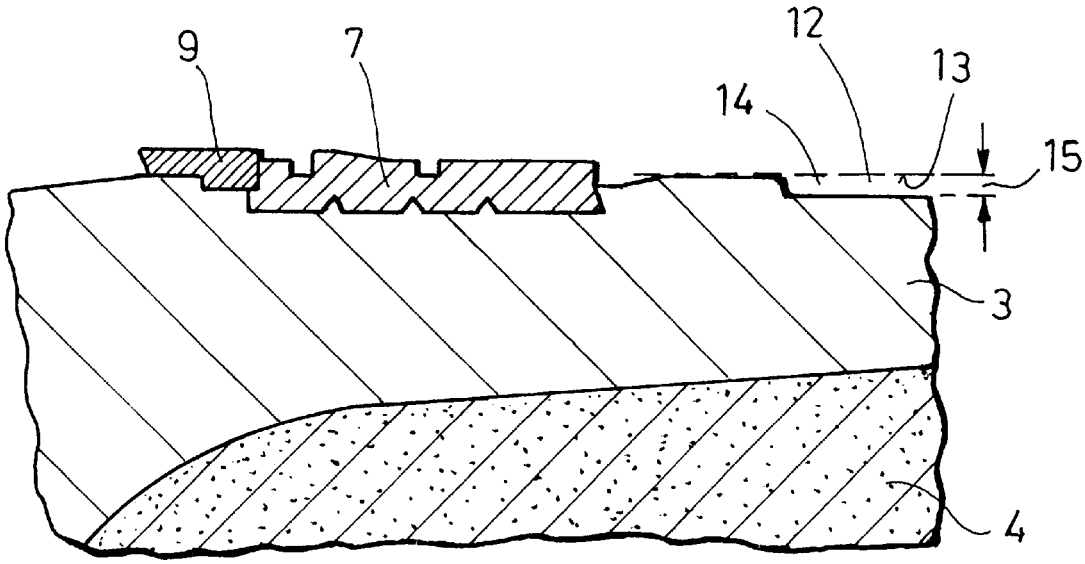
FIG. 2 is a fragmentary axial sectional view of the inset II of FIG. 1.

A guide band 7 of soft iron is circumferentially secured to a rear portion 8 of the projectile body 3 in a formfitting manner. As shown in FIG. 2, behind the guide band 7 a nylon obturator ring 9 is arranged which directly adjoins the guide band 7.

According to the invention, between the guide band 7 and a guide bead 10 which borders the rearward end of the ogive-shaped frontal region 2 of the projectile, in a partial region 11 of a length L1 an annular undercut 12 is provided which extends circumferentially about the projectile 1. The undercut is configured in such a manner that the annular chamber 14 formed between the outer surface of the projectile body 3 and the inner wall 13 of the weapon barrel provides for a pressure equalization of the combustion gases which flow past the projectile—occasionally on one side thereof—and thus effect a centering of the projectile 1 in the weapon barrel.

For obtaining the above-noted centering, the length L1 of the undercut 12 in an actual embodiment has been chosen as 75% of the total length L0 of the cylindrical part of the projectile body situated in front of the guide band 7. The remaining length $\delta L = L0 - L1$ of the cylindrical projectile part is subdivided into a first length portion of approximately 33% between the guide band 7 and the undercut 12 and a second length portion of approximately 66% for the guide bead 10.

The depth 15 of undercut 12 depends from the caliber of the projectile and is, as a rule, between 0.3 and 0.6% of the maximum half-diameter of the projectile.

It will be understood that the above description of the present invention is susceptible to various modifications, changes and adaptations, and the same are intended to be comprehended within the meaning and range of equivalents of the appended claims.

What is claimed is:

1. A spin-stabilized projectile adapted to be fired from a weapon barrel, comprising (a) a projectile body having a length dimension, a rear length portion, an ogive-shaped front length portion and an intermediate cylindrical length portion situated between said rear and front length portions;

(b) a soft-iron guide band circumferentially mounted on said projectile body and having a front circumferential edge oriented toward said front length portion; said intermediate length portion having a length extending from said front circumferential edge of said soft-iron guide band to said front length portion; said soft-iron guide band having a rear circumferential edge opposite said front circumferential edge thereof;

(c) a heat-resistant elastomer sealing ring circumferentially mounted on said projectile body and facing said rear circumferential edge of said soft-iron guide band; and (d) an undercut provided circumferentially in said intermediate length portion for defining an annular chamber with an inner surface of the weapon barrel during travel of the projectile in the weapon barrel upon firing to effect a pressure equalization of propellant gases flowing past said soft-iron guide band for centering the projectile within the weapon barrel; a length of said undercut measured parallel to the length dimension of the projectile being between 70% and 80% of the length of said intermediate length portion; a distance of said undercut from said front edge of said metal guide band being approximately 33% of the difference between the length of said intermediate length portion and the length of said undercut; a depth of said undercut being between 0.3% and 0.6% of one half of the maximum projectile diameter.

2. The spin-stabilized projectile as defined in claim 1, wherein a length of said undercut measured parallel to the length dimension of the projectile is 75% of the length of said intermediate length portion.

3. The spin-stabilized projectile as defined in claim 1, wherein said sealing ring is of nylon.

4. The spin-stabilized projectile as defined in claim 1, wherein said sealing ring directly adjoins said metal guide band.

* * * * *